United States Patent [19]

Blanchet-Fincher et al.

[11] Patent Number: 5,043,237

[45] Date of Patent: Aug. 27, 1991

[54] INHIBITOR-CONTAINING PHOTOHARDENABLE ELECTROSTATIC MASTER COMPOSITIONS HAVING IMPROVED RESOLUTION

[75] Inventors: Graciela B. Blanchet-Fincher; Catherine Teh-Lin Chang, both of Wilmington, Del.

[73] Assignee: E. I. du Pont de Nemours and Company, Wilmington, Del.

[21] Appl. No.: 464,058

[22] Filed: Jan. 12, 1990

[51] Int. Cl.[5] ..... G03G 13/26

[52] U.S. Cl. ..... 430/49; 430/281; 430/43

[58] Field of Search ..... 430/49, 43, 281

[56] References Cited

U.S. PATENT DOCUMENTS 4,849,314 7/1989 Fincher et al. ..... 430/49

*Primary Examiner*—David Welsch

[57] ABSTRACT

Photohardenable electrostatic master with improved environmental latitude and dot shape comprising (1) an electrically conductive substrate, and coated thereon (2) a layer of photohardenable composition having a speed that requires an exposure energy in the range of 3 to 90 mjoules/sq. cm. consisting essentially of (a) at least two incompatible organic polymeric binders, (b) at least one monomeric compound having at least ethylenically unsaturated group, and (c) a photoinitiator or photoinitiator system that activates polymerization of the ethylenically unsaturated monomer upon exposure to actinic radiation, (d) a chain transfer agent, and (e) at least one polymerization inhibitor in an amount of at least 0.1% by weight based on the total weight of photohardenable composition.

A xeroprinting process is described using the master. The master is used in graphic arts, color proofing which duplicates images produced by printing, preparation of printed circuit boards, resists, soldermasks, etc.

36 Claims, 1 Drawing Sheet

INHIBITOR-CONTAINING PHOTOHARDENABLE ELECTROSTATIC MASTER COMPOSITIONS HAVING IMPROVED RESOLUTION

FIELD OF THE INVENTION

This invention relates to a photohardenable electrostatic master for xeroprinting. More particularly this invention relates to an improved photohardenable electrostatic master having on an electrically conductive substrate a layer of a photohardenable composition which contains at least two incompatible binders and a polymerization inhibitor compound.

BACKGROUND OF THE INVENTION

The xeroprinting process employs a printing plate, commonly referred to as a "master", made by creating a pattern of insulating material, i.e., an image, on the surface of a grounded conductive substrate. In the xeroprinting process, an electrostatic charge is applied to the surface of the master, e.g., by corona discharge. The portion of the master bearing the insulating material retains the charge, while the charge on the remainder of the master is discharged through the grounded conductive substrate. Thus, a latent image of electrostatic charge is formed on the insulating material, the image subsequently being developed with either oppositely charged particles commonly referred to as "toner" or liquid electrostatic developers. The toner is then transferred, e.g., by electrostatic or other means, to another surface, e.g., paper or polymeric film, where it is fused, i.e., "fixed", to reproduce the image of the master. Since the image on the master is permanent multiple copies can be made by repeating the charging, toning and transfer steps.

Riesenfeld et al. U.S. Pat. No. 4,732,831 discloses an improved xeroprinting process that employs a master having a photopolymerizable or photohardenable coating on a conducting substrate. The coating contains an organic polymeric binder, an ethylenically unsaturated monomer, and a photoinitiator system. When the master is exposed to the desired pattern of actinic radiation (i.e., light of a suitable wavelength), exposed regions of the coating polymerize and exhibit a significantly higher electrical resistance than unexposed regions. Thus, when the master is subsequently used in the xeroprinting process, the polymerized regions will hold an electrical charge, which is developed with toner, while the unpolymerized regions discharge to ground through the conductive backing and therefore do not attract the toner.

It has been found that the electrostatic properties of the photopolymerizable masters change considerably with small variations in ambient temperature around room temperature. These changes in electrical properties with ambient temperature and humidity degrade image quality and dot gain. It has also been found that when blends of binders of significantly different Tg's are incorporated into formulations the environmental stability of the photopolymer electrostatic masters improve noticeably. In general, a high Tg/high resistivity binder such as poly(styrene/methyl methacrylate) (70:30) was mixed with a lower Tg binder, e.g., high molecular weight Elvacite® 2042 or Elvacite® 2045. Multiple binders were introduced to broaden the glass transition of the exposed and unexposed regions. They improved the overall master performance by reducing the variation of viscosity, which, in turn, is associated with the variations in discharge rate, with temperature fluctuations. At high temperatures, the unexposed master discharges more rapidly and, as a result the dot gain decreases and ultimately the highlight dots are lost. In contrast, a decrease in discharge rate at low temperatures is associated with loss of shadows dots and increased dot gain. Although multiple binder systems noticeably improved the environmental performance, especially in the range of 30% ≦relative humidity, ≦60% and 60° F. (15.6° C.) ≦temperature ≦80° F. (26.7° C.), light scattering adversely affected the dot range and exposure latitude achievable with single binder systems.

In general, most polymeric binders of reasonable molecular weight are incompatible with one another. The result of this is that at typical concentrations one observes phase separation of the two binders within the mixture. A standard method of detecting phase separation is the cloud point as a function of temperature or concentration. The cloud point is where there is formed small volume elements rich in one polymer and poor in the other along with other volume elements of opposite nature. The dimensions of these volume elements are typically about the wavelength of light. These small regions of fluctuating dielectric constant (or index of refraction) result in a large amount of scattering and hence the cloudy nature of the mixture.

Haziness and dot range (or lack thereof) are a direct result of the phase separation or binder incompatibility. In a clear photopolymerizable system the incident photon is absorbed within a distance of about $1/\lambda$ in the direction of the incident light wherein $\lambda$ is the wavelength of the incident light. In the case of multiple binders light scatters at the interfaces of the two phases and the photon re-radiates in any angle before polymerization occurs. As a result, although the light travels the same distance of $1/\lambda$, the direction has changed and polymerization can occur in regions where it is not desired.

It has now been found that a photohardenable electrostatic master having improved resolution, wherein the dot range of reproduced halftone dots and exposure latitude are controlled, can be made by introducing into the photohardenable composition forming the photohardenable layer a polymerization inhibitor of the type and in the amount set out below.

SUMMARY OF THE INVENTION

In accordance with this invention there is provided a photohardenable electrostatic master comprising (1) an electrically conductive substrate, and coated thereon (2) a layer of photohardenable composition having a speed that requires an exposure energy in the range of 3 to 90 mjoules/sq. cm. consisting essentially of (a) at least two incompatible organic polymeric binders, (b) at least one monomeric compound having at least one ethylenically unsaturated group, (c) a photoinitiator or photoinitiator system that activates polymerization of the at least one ethylenically unsaturated monomer upon exposure to actinic radiation, (d) a chain transfer agent, and (e) at least one polymerization inhibitor in an amount of at least 0.1% by weight based on the total weight of photohardenable composition.

In accordance with an embodiment of this invention there is provided a xeroprinting process comprising (A) exposing imagewise to actinic radiation a photohardenable electrostatic master comprising
  (1) an electrically conductive substrate, and coated thereon
  (2) a layer of photohardenable composition having a speed that requires an exposure energy in the range of 3 to 90 mjoules/sq. cm. consisting essentially of
    (a) at least two incompatible organic polymeric binders,
    (b) at least one monomeric compound having at least one ethylenically unsaturated group,
    (c) a photoinitiator or photoinitiator system that activates polymerization of the at least one ethylenically unsaturated monomer upon exposure to actinic radiation,
    (d) a chain transfer agent, and
    (e) at least one polymerization inhibitor in an amount of at least 0.1% by weight based on the total weight of photohardenable composition, (B) charging the photohardenable master electrostatically, and (C) applying to the charged photohardenable master an oppositely charged electrostatic toner.

BRIEF DESCRIPTION OF THE DRAWINGS

In the accompanying drawing which form a material part of this invention.

DETAILED DESCRIPTION OF THE INVENTION

Figure 1:
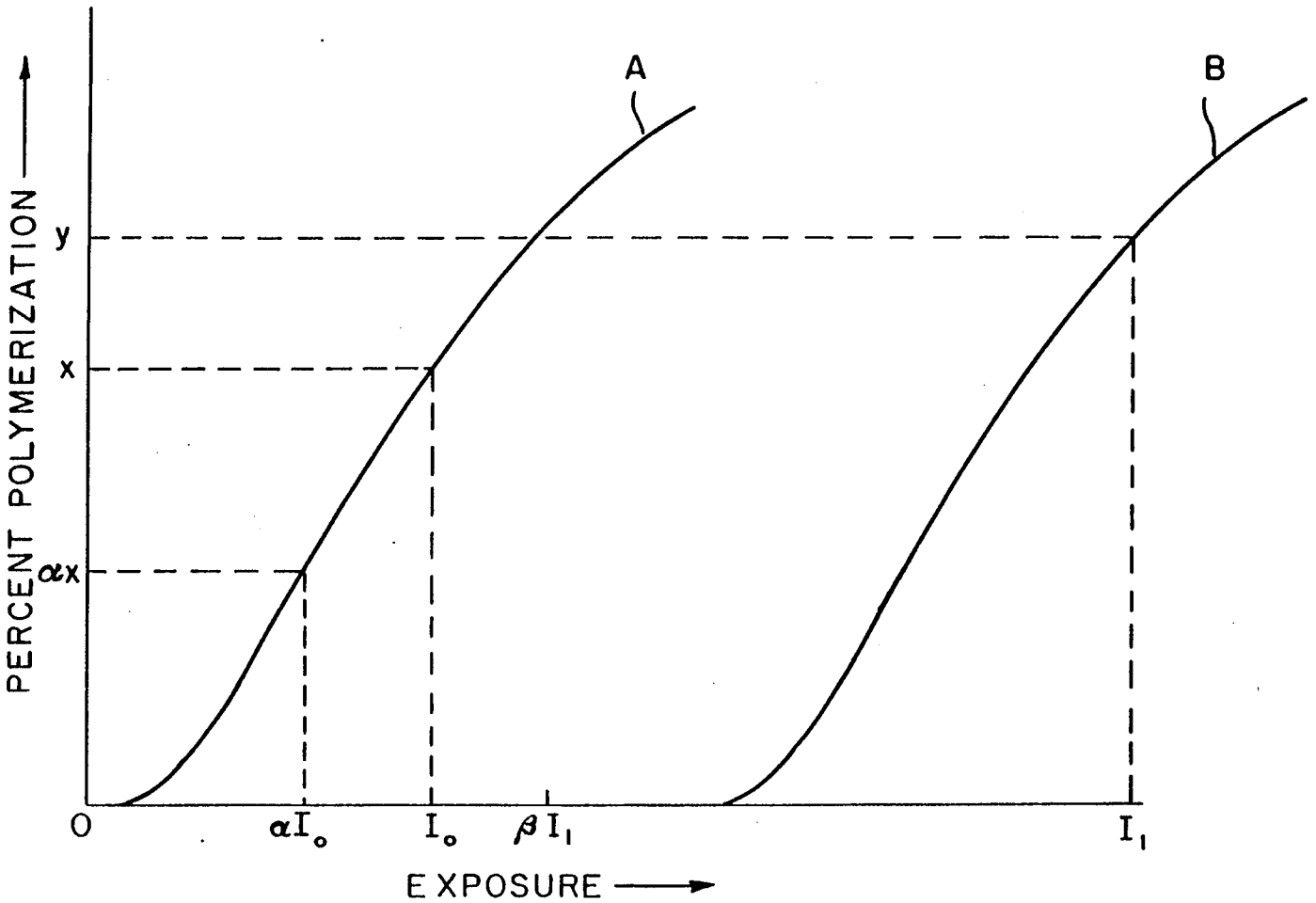
FIG. 1 is a graph showing the percent polymerization for given photon intensity for a photohardenable layer of the prior art (Curve A) and a photohardenable layer of the invention (Curve B).

Throughout the specification the below-listed terms have the following meanings:

In the claims appended hereto "consisting essentially of" means the composition of the photohardenable layer does not exclude unspecified components which do not prevent the advantages of the layer from being realized. For example, in addition to the primary components described below, there can be present additional components, such as sensitizers, including visible sensitizers, antihalation agents, UV absorbers, release agents, colorants, surfactants, plasticizers, electron donors, electron acceptors, charge carriers, etc., also described below.

Photohardenable and photopolymerizable are used interchangeably in this invention.

Glass transition temperature (Tg) is the main characteristic temperature above which the amorphous polymer acquires sufficient thermal energy and changes from a glassy to a rubbery state accompanied by significant changes in physical properties due to facilitated molecular motion.

Monomer means simple monomers, as well as polymers, usually of molecular weights below 1500, having at least one, preferably two or more, ethylenic groups capable of crosslinking or addition polymerization.

Photopolymerizable layers having improved environmental latitude as well as improved resolution have a broadened glass transition temperatures in the unexposed state with respect to such layers having a single binder. The glass transition range is broadened by introducing into the formulation a blend of binders having at least one with a high Tg and at least one with a low Tg. Blends of monomers in these formulations also have been found to further improve environmental latitude. The binder mixture consists of at least two materials with different glass transition temperatures. In general, it has been found that a high Tg binder (approximately in the range of 80°-110° C.) and a low Tg binder (approximately in the range of 50°-70° C.) are preferred. The molecular weights of the low Tg binders were found not to have a noticeable effect in the temperature stability of the photohardenable composition and mainly modified coating properties.

It has now been found that dot range and exposure latitude are improved by introducing polymerization inhibitors into the formulation. Polymerization inhibitors extend the induction period before polymerization starts, the induction period being proportional to the inhibitor concentration. Polymerization inhibitors as described below are effective in improving the dot range of the incompatible binder containing formulations. The effect of simple inhibition on dot range in incompatible binder formulations of photopolymerizable compositions can be understood from FIG. 1.

FIG. 1, curve A, which illustrates the prior art, shows that an exposure, $I_o$, of photons produces x percent of polymerization while an exposure, $\alpha I_o$, of photons scattered into areas where polymerization is not desired produces $\alpha x$ percent of polymerization. In curve B, which illustrates the invention, an exposure, $I_1$, of photons produces y percent of polymerization, but the exposure, $\beta I_1$, of photons scattered into areas where polymerization is not desired produces no polymerization since the intensity of these photons is too low to overcome the induction period of the polymerization inhibited photohardenable composition.

The primary components include:

BINDERS

Suitable binders include: acrylate and methacrylate polymers and co- or terpolymers, vinyl polymers and copolymers, polyvinyl acetals, polyesters, polycarbonates, polyurethanes, polysulfones, polyetherimides and polyphenylene oxides, butadiene copolymers, cellulose esters, cellulose ethers, etc. For formulations having improved environmental latitude the selection of a polymeric binders depends on their Tg's. The Tg of a polymer is affected by the chemical structures of the main chain and the side groups. Polymers with rigid structures generally show high Tg's while more flexible polymers exhibit low Tg's. Polymers of desired Tg's may be obtained by copolymerization of proper combinations of rigid and flexible monomers. The following publication which summarizes glass transition temperatures of homopolymers known in the literature, "POLYMER HANDBOOK", ed. J. Brandrup & E. H. Immergut, John Wiley & Sons, Inc., 1975, is incorporated herein by reference. Section III-140-192 of said publication lists Tg's of most known polymers.

Examples of useful binders having Tg's greater than 80° C. include:

| TRADE NAME OR CODE | CHEMICAL COMPOSITION | Tg (°C.) |
|---|---|---|
| | Vinyl polymers & copolymers | |
| PSMMA | Poly(styrene(70)/methyl | 95 |

-continued

| TRADE NAME OR CODE | CHEMICAL COMPOSITION | Tg (°C.) |
|---|---|---|
| | methacrylate(30)) | |
| Cycolac ® CTB | Acrylonitrile/butadiene/ styrene | 80-84 |
| (Borg-Warner) | Polystyrene | 100 |
| | Poly(alpha-methylstyrene) | 168 |
| | Poly(vinyl chloride) | 80 |
| | Poly(vinylidene chloride) | 100 |
| | Poly(acrylonitrile) | 96 |
| | Methacrylate polymers & copolymers | |
| | Poly(methyl methacrylate) | 110 |
| | Poly(isobornyl methacrylate) | 147 |
| | Poly(phenyl methacrylate) | 110 |
| | Poly(t-butyl methacrylate) | 107 |
| | Poly(isopropyl methacrylate) | 81 |
| | Condensation polymers | |
| Lexan ® 101 (G.E.) | Polycarbonate | 150 |
| | Polysulfone | 190 |
| ULTEM ® (G.E.) | Polyetherimide | 215 |
| | Poly(phenylene oxide) | 210 |
| | Poly(1,4-cyclohexanedimethanol terephthalate) | 85 |
| | Polyvinyl acetals | |
| | Poly(vinyl acetal) | 83 |
| Formvar ® (Monsanto) | Poly(vinyl formal) | 92-113 |

Examples of usefule binders having Tg's less than 70° C. include:

| TRADE NAME OR CODE | CHEMICAL COMPOSITION | Tg (°C.) |
|---|---|---|
| | Acrylate, methacrylate polymers & copolymers | |
| | Poly(ethyl methacrylate) | 70 |
| Elvacite ® 2042 | Poly(ethyl methacrylate) | 65 |
| Elvacite ® 2045 | Poly(isobutyl methacrylate) | 55 |
| Elvacite ® 2014 | Methyl methacrylate - copolymer | 40 |
| Elvacite ® 2044 | Poly(n-butyl methacrylate) | 15 |
| Elvacite ® 2046 | Poly(n-butyl/isobutyl methacrylate) | 35 |
| (E. I. du Pont de Nemours & Co.) | Poly(cyclohexyl methacrylate) | 66 |
| | Poly(t-butyl acrylate) | 41 |
| | Vinyl esters & copolymers | |
| | Poly(vinyl acetate) | 32 |
| | Vinyl polymers & copolymers | |
| | Vinyl chloride/vinyl acetate copolymer | 63 |
| | Polyvinyl acetals | |
| Butvar ® (Monsanto) | Poly(vinyl butyral) | 62-68 |
| | Polyurethanes | |
| Estane ® 5715 (B. F. Goodrich) | Polyurethane | 16 |
| | Polyesters | |
| | Poly(tetramethylene terephthalate) | 45 |
| | Butadiene copolymers | |
| | Styrene/butadiene copolymers | <70 |
| | Cellulose esters and ethers | |
| | Ethyl cellulose | 43 |

Preferred binders include the Elvacite ® resins because their Tg's range from 15° C. to 105° C. Low Tg resins include poly(ethyl methacrylate) (Tg 70° C.), Elvacite ® 2045 or 2042, in combination with high Tg resins poly(methyl methacrylate) (Tg 110° C.) or poly(-styrene/methyl methacrylate) are particularly preferred. The binder combination of poly(ethyl methacrylate) (Tg 70° C.) and poly(styrene/methyl methacrylate) gave photopolymerizable compositions with good environmental response and coating properties.

The mixed binders should have a resistivity in the range of $10^{13}$ to $10^{20}$ ohm-cm, preferably $10^{13}$ to $10^{16}$ ohm-cm.

MONOMERS

Any ethylenically unsaturated photopolymerizable or photocrosslinkable compounds suitable for use with hexaarylbiimidazole initiator systems can be used in the practice of this invention.

Preferred monomers which have at least two terminally ethylenically unsaturated groups are di-, tri-, and tetraacrylates and methacrylates such as ethylene glycol diacrylate, diethylene glycol diacrylate, triethylene glycol diacrylate, glycerol diacrylate, glycerol triacrylate, glycerol propoxylated triacrylate, ethylene glycol dimethacrylate, 1,2-propanediol dimethacrylate, 1,2,4-butanetriol trimethacrylate, 1,4-cyclohexanediol diacrylate, 1,4-benzenediol dimethacrylate, pentaerythritol triacrylate, pentaerythritol trimethacrylate, pentaerythritol tetramethacrylate, 1,3-propanediol diacrylate, 1,5-pentanediol dimethacrylate, trimethylolpropane triacrylate, ethoxylated trimethylolpropane triacrylate, the diacrylates and dimethacrylate of polyethylene glycols of molecular weight 100-500, tris-(2-hydroxyethyl) isocyanurate triacrylate, etc. Monomers containing aromatic structures, e.g., ethoxylated bisphenol A diacrylate and dimethacrylate are also useful. Especially preferred monomers are glyceryl propoxylated triacrylate, trimethylolpropane triacrylate and tris-(2-hydroxyethyl)isocyanaurate triacrylate.

A monomer with a resistivity in the range of about $10^5$ to $10^9$ ohm-cm is particularly useful. Mixtures of monomers have also been found to enhance the improvement in environmental stability of the photohardenable master. Blends of glycerol propoxylated triacrylate and trimethylolpropane triacrylate in a 2:1 ratio were found to give the best overall performance. Other monomer blends, such as tris-(2-hydroxyethyl) isocyanurate triacrylate and trimethylolpropane triacrylate show good temperature stability.

INITIATORS AND/OR INITIATOR SYSTEMS

A large number of free-radical generating compounds can be utilized in the photopolymerizable compositions. Preferred initiator systems are 2,4,5-triphenylimidazolyl dimers with hydrogen donors, also known as the 2,2'4,4',5,5'-hexaarylbiimidazoles, or HABI's, and mixtures thereof, which dissociate on exposure to actinic radiation to form the corresponding triarylimidazolyl free radicals HABI's and use of HABI-initiated photopolymerizable systems for applications other than for electrostatic uses have been previously disclosed in a number of patents. These include: Chambers, U.S. Pat. No. 3,479,185, Chang et al., U.S. Pat. No. 3,549,367, Baum and Henry, U.S. Pat. No. 3,652,275, Cescon, U.S. Pat. No.3,784,557, Dueber, U.S. Pat. No. 4,162,162, Dessauer, U.S. Pat. No. 4,252,887, Chambers et al., U.S. Pat. No. 4,264,708, Wada et al. U.S. Pat. No. 4,410,621, and Tanaka et al., U.S. Pat. No. 4,459,349, the disclosures of which are incorporated herein by reference. Useful 2,4,5-triarylimidazolyl dimers are disclosed in Baum and Henry, U.S. Pat. No. 3,652,275 column 5, line 44 to column 7, line 16, the disclosure of which is incorporated herein by reference. Any 2-o-substituted HABI disclosed in the prior patents can be used in this invention.

The HABI's can be represented by the general formula:

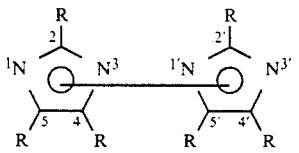

where the R's represent aryl, e.g., phenyl, naphthyl, radicals. The 2-o-substituted HABI's are those in which the aryl radicals at the 2- and 2'-positions are orthosubstituted or with polycyclic condensed aryl radicals. The other positions on the aryl radicals can be unsubstituted or carry any substituent which does not interfere with the dissociation of the HABI upon exposure or adversely affect the electrical or other characteristics of the photopolymer system.

Preferred HABI's are 2-o-chlorosubstituted hexaphenylbiimidazoles in which the other positions on the phenyl radicals are unsubstituted or substituted with chloro, methyl or methoxy. The most preferred initiators include: 2-(o-chlorophenyl)-4,5-bis(mmethoxyphenyl)imidazole dimer, 2-(o-chlorophenyl-4,5-diphenyl)imidazole dimer, and 2,5-bis(o-chlorophenyl)-4- (m,p-dimethoxyphenyl)imidazole dimer, each of which is typically used with a chain transfer agent described below.

Photoinitiators that are also useful in the photohardenable composition in place of the HABI type photoinitiators include: the substituted or unsubstituted polynuclear quinones, aromatic ketones, and benzoin ethers. Examples of such other photoinitiators are quinones, for example, 9,10-anthraquinone, 1-chloroanthraquinone, 2-chloroanthraquinone, 2-methylanthraquinone, 2-ethylanthraquinone, 2-tert-butylanthraquinone, octamethylanthraquinone, 1,4-naphthoquinone, 9,10-phenanthrenequinone, 1,2-benzanthraquinone, 2,3-benzanthraquinone, 2-methyl 1,4 naphthoquinone, 2,3-dichloronaphthoquinone, 1,4-dimethylanthraquinone, 2,3-didimethylanthrauinone, 2-phenylanthraquinone, 2,3- diphenylanthraquinone, 3-chloro-2-methylanthraquinone, 7,8,9,10-tetrahydronaphthacenequinone, 1,2,3,4-tetrahydrobenz(a)anthracene-7,12-dione; aromatic ketones, for example, benzophenone, 4,4'-bis(-dimethylamino)benzophenone; 4,4'-bis (diethylamino)-benzophenone, 4-acryloxy-4'-diethylaminobenzophenone, 4-methoxy-4'-dimethylaminobenzophenone, xanthones, thioxanthones; and benzoin ethers, for example, benzoin methyl and ethyl ethers; benzyl ketals, e.g., dimethoxy-2-phenylacetophenone. Still other photoinitiators which are also useful, are described in U.S. Pat. No. 2,760,863 and include vicinal ketaldonyl alcohols, such as benzoin, pivaloin, acyloin ethers, alpha-hydrocarbon-substituted aromatic acyloins, including alphamethylbenzoin, alphaallylbenzoin and alpha-phenylbenzoin. Additional systems include alpha-diketones with amines as disclosed in Chang, U.S. Pat. No. 3,756,827, and benzophenone with p-dimethylaminobenzaldehyde or with esters of p-dimethylaminobenzoic acid as disclosed in Barzynski et al., U.S. Pat. No. 4,113,593.

Redox systems, especially those involving dyes, e.g., Rose Bengal® 2-dibutylaminoethanol, are also useful in the practice of this invention. Photoreducible dyes and reducing agents such as those disclosed in U.S. Pat. Nos. 2,850,445; 2,875,047; 3,097,096; 3,074,974; 3,097,097; 3,145,104; and 3,579,339; as well as dyes of the phenanzine, oxazine, and quinone classes can be used to initiate photopolymerization, the disclosures of which are incorporated herein by reference. A useful discussion of dye sensitized photopolymerization can be found in "Dye Sensitized Photopolymerization" by D. F. Eaton in Adv. in Photochemistry, Vol. 13, D. H. Volman, G. S. Hammond, and K. Gollinick, eds., Wiley-Interscience, N.Y. 1986, pp. 427–487.

CHAIN TRANSFER AGENTS/CO-INITIATORS

Chain transfer agents/co-initiators identified in the prior patents for use with HABI-initiated photopolymerizable systems can be used. For example, Baum and Henry, U.S. Pat. No. 3,652,275 discloses N-phenylglycine, 1,1-dimethyl-3,5-diketocyclohexane, and organic thiols such as 2-mercaptobenzothiazole, 2-mercaptobenzoxazole, 2-mercaptobenzimidazole, pentaerythritol tetrakis(mercaptoacetate), 4-acetamidothiophenol, mercaptosuccinic acid, dodecanethiol, beta-mercaptoethanol, 1-phenyl-4H-tetrazole-5-thiol, 6-mercaptopurine monohydrate, bis-(5-mercapto-1,3,4-thiodiazol-2-yl, 2mercapto-5-nitrobenzimidazole, and 2-mercapto-4-sulfo-6-chlorobenzoxazole, the disclosure of which is incorporated by reference. Also useful are various tertiary amines known in the art, e.g., leuco dyes. Other compounds useful as chain transfer agents in photopolymer compositions include various other types of compounds, e.g., (a) ethers, (b) esters, (c) alcohols, (d) compounds containing allylic or benzylic hydrogen cumene, (e) acetals, and (f) aldehydes, as disclosed in column 12, lines 18 to 48, of MacLachlan, U.S. Pat. No. 3,390,996, the disclosure of which is incorporated herein by reference. Preferred compounds are 2-mercaptobenzoxazole (2-MBO), 2-mercaptobenzimidazole (2-MBI) and 2-mercaptobenzothiazole (2-MBT).

POLYMERIZATION INHIBITORS

Polymerization inhibitors are chemical substances which can react with free radicals, extend the induction period, and/or substantially reduce the rate of polymerization. The induction period represents the period during which polymerization cannot proceed until inhibitors are consumed. Some inhibitors are more potent than others in changing the course of polymerization depending on the chemical structure of the inhibitor, reactivity of and with free radicals, nature of monomers, the presence of other inhibitors, e.g., oxygen, and the medium in which the polymerization process occurs. Therefore, the effective concentrations of inhibitors may vary widely. Many organic and inorganic compounds are known inhibitors in free radical-initiated polymerization. (References: G. F. D'Alelio, Fundamental Principles of Polymerization, John Wiley & Sons, London, p. 323–330, 1952; P. J. Flory, Principles of Polymer Chemistry, Cornell University Press, Ithaca, N.Y., p. 161–177, 1953). Useful polymerization inhibitors include aromatic compounds containing quinonoid, nitro, nitroso, amino or phenolic structures, e.g., cyclic phenylhydrazides, e.g., 1-phenylpyrazolidine-3-one (phenidone), 1-phenyl-4-methylpyrazolidine-3-one (phenidone B), 1-phenyl-4,4-dimethylpyrazolidine-3-one (dimezone) and other compounds disclosed in Dessauer and Firmani, column 5, lines 20 to 52, the disclosure of which is incorporated herein by reference; alkyl and aryl-substituted phenols, e.g., p-methoxyphenol, 2,6-di-tert-butyl p-cresol; hydroquinones and quinones, e.g., hydroquinone, p-toluquinone, p-benzoquinone, etc.; tert-butyl catechol, 1,2,3-trihydroxybenzene, beta-naphthol, phenothiazine, nitro compounds, e.g., nitrobenzene, dinitrobenzene, trinitrofluorenone, etc. The dinitroso dimers described in Pazos, U.S. Pat. No. 4,168,982 are also useful, the disclosure of which is incorporated herein by reference; aromatic amine inhibitors p-phenylenediamine, nitrodimethylaniline, hydroxymethylaniline and nitrosodimethylaniline, etc. Preferred inhibitors are TAOBN, i.e., 1,4,4-trimethyl-2,3-diazobicyclo-(3.2.2)-non-2-ene-N,N-dioxide, 1-phenylpyrazolidine-3-one and p-benzoquinone. Other polymerization inhibitors are disclosed in Pazos U.S. Pat. No. 4,198,242, the disclosure of which is incorporated herein by reference. A specific polymerization inhibitor is 1-(2'-nitro-4',5'-dimethoxy)pneyl-1-(4-t-butylphenoxy) ethane. These inhibitors can be used singly or in combination.

ADDITIONAL COMPONENTS

The photohardenable compositions may also contain other ingredients which are conventional components used in photopolymerizable systems. Such components include: sensitizers, antihalation agents, Uv absorbers, release agents, colorants, surfactants, plasticizers, electron donors, electron acceptors, charge carriers, etc.

Sensitizers useful with these photoinitiators include those disclosed in U.S. Pat. Nos. 3,554,753; 3,563,750; 3,563,751; 3,647,467; 3,652,275; 4,162,162; 4,268,667; 4,351,893; 4,454,218; 4,535,052; and 4,565,769, the disclosures of which are incorporated hereby by reference.

A preferred group of visible sensitizers include the bis(p-dialkylaminobenzylidene) ketones disclosed in Baum and Henry, U.S. Pat. No. 3,652,275 and the arylyidene aryl ketones disclosed in Dueber, U.S. Pat. No. 4,162,162, as well as in U.S. Pat. Nos. 4,268,667 and 4,351,893, the disclosure of each being incorporated herein by reference. These compounds extend the sensitivity of the initiator system to visible wavelengths where lasers emit. Particularly preferred sensitizers are DMJDI: 2-[9'-(2',3',6',7'-tetrahydro-1-H,5H-benzo [i,j]-quinolylidene}-5,6-dimethoxyl-1-indanone and JAW: 2,5-Bis }9'-(2',3',6',7',-tetrahydro-1-H,5H-benzo[i,j]-quinolylidene)}cyclopentanone which have the following structures, respectively:

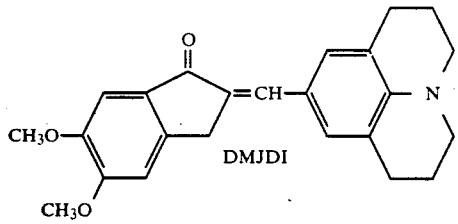

DMJDI

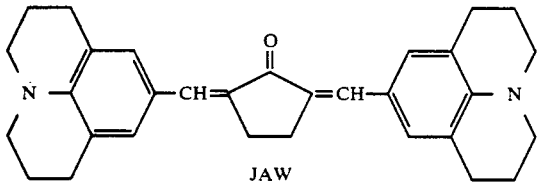

JAW

Antihalation agents useful in the photohardenable compositions include known antihalation dyes.

Ultraviolet radiation absorbing materials which minimize optical effects, such as light scattering, useful in the invention are disclosed in U.S. Pat. No. 3,854,950, the disclosure of which is incorporated herein by reference.

Compounds present in the composition as release agents are described in Bauer, U.S. Pat. No. 4,326,010, the disclosure of which is incorporated herein by reference. A specific release agent is polycaprolactone.

Suitable plasticizers include: triethylene glycol, triethylene glycol dipropionate, triethylene glycol dicaprylate, triethylene glycol bis(2-ethyl hexanoate), tetraethylene glycol diheptanoate, polyethylene glycol, diethyl adipate, tributyl phosphate, phthalate and benzoate compounds, etc. Other plasticizers that yield equivalent results will be apparent to those skilled in the art.

Suitable electron donors and acceptors are disclosed in Blanchet-Fincher et al., U.S. Pat. No. 4,849,314, the disclosure of which is incorporated herein by reference.

Suitable charge carriers are disclosed in Blanchet-Fincher et al. U.S. Pat. No. 4,818,660, the disclosure of which is incorporated herein by reference.

PROPORTIONS

In general, the components should be used in the following approximate proportions: total binder 40–70%, preferably 50–65%; total monomer 10–40%, preferably 20–35%; photoinitiator 1–20%, preferably 2–10%, chain transfer agent 0.05–10%, preferably 0.05–4%; and polymerization inhibitor(s) 0.1–4%, preferably 0.1–2.5%. These are weight percentages based on total weight of the photopolymerizable or photohardenable system.

The preferred proportions depend upon the particular compounds selected for each component and the application for which the photohardenable composition is intended. The amounts of chain transfer agent and polymerization inhibitor should be such that a film speed that requires an exposure energy in the range of 3 to 90, preferably 3 to 30, mjoules/sq. cm. is achieved. Also, a high conductivity monomer can be used in smaller amount than a low conductivity monomer, since the former will be more efficient in eliminating charge from unexposed areas.

The amount of photoinitiator, e.g., HABI, will depend upon film speed requirement. Photohardenable compositions with HABI content above 10% provide films of high sensitivity (high speed) and can be used with laser imaging in recording digitized information, as in digital color proofing. Such films are the subject of Legere U.S. Ser. No. 07/284,861, filed Dec. 13, 1988. For analog applications, e.g., exposure through a negative, film speed requirement depends upon mode of exposure. Films with slower photospeed are acceptable for analog applications.

COATING/SUBSTRATES

The photohardenable layer is prepared by mixing the ingredients of the photopolymerizable composition in a solvent, such as methylene chloride, usually in the weight ratio of about 15:85 to 25:75 (solids to solvent), coating on a substrate, and evaporating the solvent. Coatings should be uniform and should have a thickness of 3 to 20 μm, preferably 7 to 12 μm, when dry. Dry coating weight should be about 30 to 200 mg/dm$^2$, preferably 80 to 150 mg/dm$^2$. A coversheet, e.g., polyethylene, polypropylene, polyethylene terephthalate, etc., is preferably placed over the photohardenable layer after the solvent evaporates for protection.

The substrate should be uniform and free of defects such as pinholes, bumps, and scratches. It can be a support, such as paper, glass, synthetic resin and the like, which has been coated by vapor deposition or sputtering chemical deposition on one or both sides with a metal, conductive metal oxide, or metal halide, such as aluminized polyethylene terephthalate; or a conductive paper or polymeric film. The coated substrate mounted directly on a conductive support can be mounted directly on the printing device.

Alternatively, the substrate can be a non-conducting film, preferably a release film such as polyethylene or polypropylene. After removal of the protective cover sheet, the photohardenable layer can then be laminated to a conductive support on the printing device with the tacky, photohardenable layer adjacent to the support The substrate then acts as a coversheet which is removed after exposure but prior to charging.

As another alternative, the conductive support may be a metal plate, such as aluminum, copper, zinc, silver or the like; or a support which has been coated with a polymeric binder containing a metal, conductive metal oxide, metal halide, conductive polymer, carbon, or other conductive filler.

ELECTRICAL CHARACTERISTICS

To evaluate the photohardenable compositions, voltage is measured on the unexposed photohardenable layer as a function of time using standard conditions of charging and measurement.

The desired electrical properties of the photohardenable element are dependent on the charge deposited on the photohardenable surface and the electrical characteristics of the particular toner system employed. Ideally, at the time of contact, e.g., with a developer dispersion, the voltage in the exposed areas (Vexp) should be at least 10 V, preferably at least 100 V and even up to 400 V or higher, more than that of the voltage in unexposed areas (Vunexp). Resistivity of the exposed areas should be between about $10^{14}$ and $10^{17}$ Ohm-Cm. Resistivity in the unexposed areas should be between $10^{12}$ and $10^{15}$ ohm-Cm and the ratio of resistivity in exposed areas to resistivity in unexposed areas should be at least 100. A typical time for toner or developer application is between 1 and 5 seconds after charging.

EXPOSURE/CHARGING/TONING/TRANSFER

To provide the required conductivity differential, exposure must be sufficient to cause substantial polymerization in exposed areas. Exposing radiation can be modulated by either digital or analog means. Analog exposure utilizes a line or halftone negative or other pattern interposed between the radiation source and film. For analog exposure an ultraviolet light source is preferred, since the photopolymerizable system is most sensitive to shorter wavelength radiation. Digital exposure may be carried out by a computer controlled, light-emitting laser which scans the film in raster fashion. For digital exposure a high speed film, i.e., one which contains a high level of HABI and which has been sensitized to longer wavelengths with a sensitizing dye, is preferred. Electron beam exposure can be used, but is not preferred because of the expensive equipment required.

The preferred electrostatic charging means is corona discharge. Other charging methods include: discharge of a capacitor, negative corona discharge, shielded corotron, scorotron, etc.

Any electrostatic toner or developer and any method of developer application can be used. Liquid toners, i.e., a suspension of pigmented resin toner particles in a nonpolar dispersant liquid present in major amount, are preferred. The liquids normally used are Isopar® branched-chain aliphatic hydrocarbons (sold by Exxon Corporation) which have a Kauri-butanol value of less than 30. These are narrow high-purity cuts of isoparaffinic hydrocarbon fractions with the following boiling ranges Isopar®-G, 157°-176° C., Isopar®-H 176°-191° C., Isopar®-K 177°-197° C., Isopar®-L 188°-206° C., Isopar®-M 207°-254° C., Isopar®-V 254°-329° C. The liquid developers may contain various adjuvants which are described in: Mitchell, U.S. Pat. Nos. 4,631,244, 4,663,264, and 4,734,352; Taggi, U.S. Pat. No. 4,670,370; El-Sayed and Taggi, U.S. Pat. No. 4,702,984; Larson, U.S. Pat. No. 4,702,985; Trout, U.S. Pat. No. 4,707,429; Larson and Trout U.S. Pat. No. 4,681,831. The liquid electrostatic developers can be prepared as described in Larson U.S. Pat. No. 4,760,009. The disclosures in these patents are incorporated herein by reference.

Also present in the liquid electrostatic developers are thermoplastic resins, having an average particle size of less than 10 μm, which are, for example, copolymers of ethylene (80 to 99.9%) with acrylic acid, methacrylic acid, or alkyl esters, where alkyl is 1 to 5 carbon atoms, of acrylic or methacrylic acid (20 to 0.1%), e.g., an ethylene/methacrylic acid (89:11) copolymer having a melt index at 190° C. of 100. Preferred nonpolar liquid soluble ionic or zwitterionic components present in such developers, for example, are lecithin and Basic Barium Petronate® oil-soluble petroleum sulfonate, Witco Chemical Corp., New York, N.Y.

Many of the monomers useful in the photohardenable composition described above are soluble in these Isopar® hydrocarbons, especially in Isopar®-L. Consequently, repeated toning with Isopar®-based developers to make multiple copies can deteriorate the electrical properties of the photohardenable master by extraction of monomer from unexposed areas. The preferred monomers are relatively insoluble in Isopar® hydrocarbons, and extended contact with these liquids does not unduly deteriorate photohardenable layers made with these monomers. Photohardenable electrostatic masters made with other, more soluble monomers can still be used to make multiple copies, using liquid developer having a dispersant with less solvent action.

Representative dry electrostatic toners that may be used include: Kodak Ektaprint K, Hitachi HI-Toner HMT-414, Canon NP-350F toner, Toshiba T-50P toner, etc.

After developing the toned image is transferred to a receptor surface, such as paper, for the preparation of a proof. Other receptors are polymeric film, or cloth. For making integrated circuit boards, the transfer surface can be an insulating board on which conductive circuit lines can be printed by the transfer, or the surface can be an insulating board covered with a conductor, e.g., a fiber glass board covered with a copper layer, on which a resist is printed by transfer.

Transfer is accomplished by electrostatic or other means, e.g., by contact with an adhesive receptor surface. Electrostatic transfer can be accomplished in any known manner, e.g., by placing the receptor surface, e.g., paper, in contact with the toned image. A tackdown roll or corona, when held at negative voltages, will press the two surfaces together assuring intimate contact. After tackdown, a positive corona discharge is applied to the backside of the paper to drive the toner particles off the electrostatic master onto the paper.

INDUSTRIAL APPLICABILITY

The photohardenable electrostatic master having improved resolution is particularly useful in the graphic arts field, especially in the area of color proofing wherein the proofs prepared duplicate the images produced by printing. This is accomplished by controlling the gain of the reproduced halftone dots through control of the electrical conductivity of the exposed and unexposed areas of the photohardenable electrostatic master. Since the voltage retained by the halftone dots is almost linearly related to the percent dot area, the thickness of the liquid electrostatic developer will be constant everywhere on the image, independent of the particular dot pattern to be developed. Dual incompatible binder formulations containing polymerization inhibitors have highlights dots that can be improved from 3-4% to 1-2% dots, and the shadow dots can be improved from 93 to 95% to 98-99% dots. Other uses for the photohardenable master include preparation of printed circuit boards, resists, soldermask, photohardenable coatings, etc.

EXAMPLES

The advantageous properties of this invention can be observed by reference to the following examples which illustrate, but do not limit, the invention. The parts and percentages are by weight.

BINDERS

B1—Polymethyl methacrylate n=1.25, where n is the inherent viscosity Tg=110° C., where Tg is the glass transition temperature
B2—Polystyrene methylmethacrylate (70:30), Tg=95° C.
B3—Polycarbonate, Tg=150° C.
B4—Ethyl methacrylate resin, n=1.50 and Tg=70° C.
B5—Isobutyl methacrylate resin, n=0.64, Tg=55° C.
B6—Ethyl methacrylate resin, n=0.83, Tg=63° C.
B7—Methyl methacrylate resin, n=0.18, Tg=105° C.

MONOMERS

M1—Ethoxylated trimethylolpropane triacrylate
M2—Trimethyolpropane triacrylate
M3—Glycerol propoxylated triacrylate
M4—Ethoxylated bisphenol A dimethacrylate

CHAIN TRANSFER AGENT

CT1—2-mercaptobenzoxazole
CT2—2-mercaptobenzimidazole

INITIATORS

I1—2,2',4,4'-tetrakis (o-chlorophenyl)-5,5'bis(m,p-dimethoxyphenyl)biimidazole
I2—Benzoin methyl ether
I3—2,2'-bis(o-chlorophenyl)-5,5'-bis(m-methoxyphenyl)biimidazole
I4—2,2'-bis(o-chlorophenyl)-4,4',5,5'-tetraphenylbiimidazole

INHIBITORS

IN1—1-phenylpyrazolidine-3-one (phenidone)
IN2—1,4,4-trimethyl-2,3-diazobicyclo-(3.2.2)non-2ene-N-dioxide
IN3—, p-benzoquinone
IN4—Hydroquinone
IN5—1-(2'-nitro-4',5'-dimethoxy)phenyl-1-(4-t-butylphenoxy)ethane

ADDITIVES

A1—-Triphenylamine
A2—p-toluenesulfonic acid
A3—Tris-(p-diethylamino-o-tolyl)methane
A4—C. I. Solvent Red #109
A5—1-Allyl-2-thiourea Except as indicated otherwise, the following procedure was used in all examples.

A solution containing about 80 parts methylene chloride and 20 parts of solids was coated onto a 0.004 inch (0.0012 cm) aluminized polyethylene terephthalate support. After the film had been dried at 60°-95° C. to remove the methylene chloride, a 0.00075 inch (0.0019 cm) polypropylene cover sheet was laminated to the dried layer. The coating weight was varied from 80 to 150 mg/dm$^2$. The film was then wound into rolls until exposure and development occurred.

The formulations were tested for speed and dot range. In order to test the image quality of each photopolymerizable composition, the photopolymerizable layer was exposed, charged, and toned with a magenta toner and the image transferred to paper as described below. The evaluation of image quality was based on dot range versus the number of toned steps observed on the transfer image of an UGRA target. The standard paper used was 60 lbs. Solitaire ® paper, offset enamel text, Plainwell Paper Co., Plainwell, Mich. However, the process can be used with any paper. Typically, the dot range was easily tested using UGRA targets, Graphic Arts Technical Foundation, Pittsburgh, Pa., that included 0.5% highlight dots to 99.5% shadow dots in a 133 lines/mm screen that included 4 μm microlines. The UGRA target also included a continuous tone step wedge with 13 different steps. It is desired that the final image have about 5, preferably 6, toned steps in the step wedge. Typically, the desired dot range for these toned steps in the wedge is 2% to 97% or 98% dots.

The photohardenable electrostatic master was first exposed through a separation negative using a NuArc 2500 watt xenon arc light source model #631 (NuArc Company, Inc., Chicago, Ill). The speed was determined by following the steps described below. Each formulation was exposed at five different exposure times, $t_0$, $t_1$, $t_2$, $t_3$ and $t_4$. These exposure series will be referred as $t_i$ with $0 \leqq i \leqq 4$. The shortest exposure time, $t_0$, was chosen, according to the polymerization inhibitor type and concentration used in each particular photohardenable composition. The exposure times were varied from 2 to 512 seconds depending on the formulation. As standard for photographic films, the exposure series was chosen such that $t_i = 2^i t_0$. The exposed master was then mounted on a drum surface SWOP (Specification Web Offset Publications) density in the solid regions was obtained by charging the electrostatic master between 100 and 350 Volts and measured in the 99.5% area of the UGRA targets. The charged latent image was then developed with a magenta liquid electrostatic toner using a two roller toning station and the developer layer properly metered. The development and metering stations were placed at 5 and 6 o'clock respectively. The toner image was corona transferred across a liquid gap onto paper using 30-100 microamps transfer corona current and −2.5 to −4.0 kV tackdown roll voltage at a speed of 2.2 inches/second (5.59 cm/second) and fused at 110° C. for 10 seconds.

From the image, film speed and resolution data was determined in a straight forward manner The number of toned steps and the shadow dot resolution were recorded for each exposure for all formulations. It was assumed that at least five, preferably six toned steps (SW) represented a film with the desired photographic characteristics. E is the exposure time in seconds and S the exposure energy, expressed in mjoule/cm$^2$, required to achieve the 5 or 6 toned steps of the UGRA target. In all examples, the exposure energy and shadow dot, SD, are as specified.

EXAMPLES 1 to 6

Solutions of the photopolymerizable composition were prepared by dissolving the ingredients in methylene chloride at 20 to 30 parts of solids. The solids comprised monomer or combinations of monomers, combinations of binders, initiator and chain transfer agent. The solutions were coated on 0.004 inch (0.0102 cm) aluminized polyethylene terephthalate support and a 0.00075 inch (0.0019 cm) polypropylene cover sheet was provided. The coating weights varied from 80 to 150 mg/cm$^2$ or an approximate thickness of 7 $\mu$ to 12 $\mu$ in sample thickness. The photopolymerizable layer of each element had the composition in parts set out in Table 1 below.

TABLE 1

| Control or Example | M3 | I1 | CT1 | B2 | B4 | IN1 |
|---|---|---|---|---|---|---|
| C1 | 30 | 5 | 3 | 43 | 19 | 0 |
| C2 | 29.975 | 5 | 3 | 43 | 19 | 0.025 |
| C3 | 29.95 | 5 | 3 | 43 | 19 | 0.05 |
| C4 | 29.925 | 5 | 3 | 43 | 19 | 0.075 |
| C5 | 29.915 | 5 | 3 | 43 | 19 | 0.085 |
| E1 | 29.9 | 5 | 3 | 43 | 19 | 0.1 |
| E2 | 29.85 | 5 | 3 | 43 | 19 | 0.15 |
| E3 | 29.8 | 5 | 3 | 43 | 19 | 0.2 |
| E4 | 29.7 | 5 | 3 | 43 | 19 | 0.3 |
| E5 | 29.6 | 5 | 3 | 43 | 19 | 0.4 |
| E6 | 29.5 | 5 | 3 | 43 | 19 | 0.5 |

TABLE 2

| Control or Example | E (sec) | S (mJ/cm$^2$) | SW | SD (%) |
|---|---|---|---|---|
| C1 | 4 | 0.73 | 6 | 95 |
| C2 | 8 | 2.06 | 6 | 95 |
| C3 | 8 | 2.06 | 6 | 96 |
| C4 | 8 | 2.06 | 5 | 97 |
| C5 | 16 | 4.74 | 6 | 98 |
| E1 | 16 | 4.74 | 5 | 98 |
| E2 | 32 | 10.1 | 6 | 98 |
| E3 | 32 | 10.1 | 6 | 98 |
| E4 | 32 | 10.1 | 5 | 98 |
| E5 | 60 | 19.47 | 5 | 98 |
| E6 | 60 | 19.47 | 6 | 99 |

These examples illustrate that 5 to 6 toned step wedges with at least 98% shadow dots are achieved with mixed incompatible binders in a photopolymerizable composition having higher concentrations of the polymerization inhibitor.

EXAMPLE 7

A photopolymerizable element was prepared and tested as described in Examples 1 to 6 with the following exceptions: the photopolymerizable elements had the composition in parts shown in Table 3 below. Results are shown in Table 4 below. The weight of solids was 23.9%.

TABLE 3

| B2 | B4 | M3 | I1 | CT1 | A3 | A5 | IN5 |
|---|---|---|---|---|---|---|---|
| 43 | 21.5 | 28 | 4 | 0.1 | 2.2 | 0.5 | 0.7 |

TABLE 4

| E (sec) | S (mJ/cm$^2$) | SW | HD (%)* | SD (%) |
|---|---|---|---|---|
| 2.1 | 4.2 | 5 | 2 | 98 |

*HD means highlight dots

EXAMPLES 8 to 12

Photopolymerizable elements were prepared and tested as described in Examples 1 to 6 with the following exceptions: the photopolymerizable elements had the composition in parts shown in Table 5 below. Results are shown in Table 6 below.

TABLE 5

| Control or Example | M3 | I1 | CT1 | B2 | B4 | IN2 | IN4 | IN5 |
|---|---|---|---|---|---|---|---|---|
| C6 | 30 | 5 | 3 | 43 | 19 | | | |
| E8 | 29.9 | 5 | 3 | 43 | 19 | 0.1 | | |
| E9 | 29.5 | 5 | 3 | 43 | 19 | 0.5 | | |
| E10 | 29 | 5 | 3 | 43 | 19 | 1.0 | | |
| E11 | 31 | 5 | 3 | 41.5 | 19 | | 0.5 | |
| E12 | 27.5 | 5 | 3 | 43 | 19 | | | 2.5 |

TABLE 6

| Control or Example | E (sec) | S (mJ/cm$^2$) | SW | SD (%) |
|---|---|---|---|---|
| C6 | 4 | 0.73 | 6 | 95 |
| E8 | 40 | 12.78 | 6 | 99 |
| E9 | 40 | 12.78 | 6 | 98 |
| E10 | 60 | 19.47 | 6 | 98 |
| E11 | 64 | 20.81 | 6 | 99 |
| E12 | 80 | 26.16 | 6 | 99 |

EXAMPLES 13 to 15

Photopolymerizable elements were prepared and tested as described in Examples 1 to 6 with the following exceptions: the photopolymerizable elements had the composition in parts shown in Table 7 below. Results are shown in Table 8 below.

TABLE 7

| Control or Example | M1 | I1 | I2 | I3 | CT1 | CT2 | B2 | B4 | IN1 |
|---|---|---|---|---|---|---|---|---|---|
| C7 | 27 | | 5 | | 3 | | 46 | 19 | |
| E13 | 26.5 | | 5 | | 3 | | 46 | 19 | 0.5 |
| C8 | 28 | | | 3 | 3 | | 46 | 20 | |
| E14 | 27.5 | | | 3 | 3 | | 46 | 20 | 0.5 |
| C9 | 29 | 5 | | | | 3 | 44 | 19 | |
| E15 | 28.5 | 5 | | | | 3 | 44 | 19 | 0.5 |

TABLE 8

| Control or Example | E (sec) | S (mJ/cm$^2$) | SW | SD (%) |
|---|---|---|---|---|
| C7 | 32 | 10.1 | 6 | 95 |
| E13 | 128 | 43.23 | 7 | 98 |
| C8 | 8 | 2.06 | 6 | 96 |
| E14 | 256 | 85.07 | 6 | 98 |
| C9 | 4 | 0.73 | 6 | 95 |
| E15 | 64 | 20.81 | 5 | 98 |

EXAMPLES 16 to 20

Photopolymerizable elements were prepared and tested as described in Examples 1 to 6 with the following exceptions: the photopolymerizable elements had the composition in parts shown in Table 9 below. Results are shown in Table 10 below.

TABLE 9

| Control or Example | M3 | M2 | I1 | CT1 | B1 | B2 | B3 | B4 | B5 | B6 | B7 | IN1 |
|---|---|---|---|---|---|---|---|---|---|---|---|---|
| C10 | 18 | 10 | 5 | 3 | | 44 | | | 20 | | | |
| E16 | 17.75 | 10 | 5 | 3 | | 44 | | | 20 | | | 0.25 |
| C11 | 20 | 14 | 5 | 3 | | | 38 | | 20 | | | |
| E17 | 19.75 | 14 | 5 | 3 | | | 38 | | 20 | | | 0.25 |
| C12 | 20 | 10 | 5 | 3 | | 42 | | | | 20 | | |
| E18 | 19.75 | 10 | 5 | 3 | | 42 | | | | 20 | | 0.25 |
| C13 | 20 | 14 | 5 | 3 | | 38 | | | | | 20 | |
| E19 | 19.75 | 14 | 5 | 3 | | 38 | | | | | 20 | 0.25 |
| C14 | 16 | 10 | 5 | 3 | 46 | | | 20 | | | | |
| E20 | 15.75 | 10 | 5 | 3 | 46 | | | 20 | | | | 0.25 |

TABLE 10

| Control or Example | E (sec) | S (mJ/cm$^2$) | SW | SD (%) |
|---|---|---|---|---|
| C10 | 8 | 2.06 | 6 | 96 |
| E16 | 64 | 20.8 | 5 | 98 |
| C11 | 8 | 2.06 | 7 | 96 |
| E17A | 32 | 10.1 | 5 | 98 |
| E17B | 64 | 20.81 | 7 | 98 |
| C12A | 8 | 2.06 | 5 | 97 |
| C12B | 16 | 4.73 | 7 | 93 |
| E18 | 64 | 20.81 | 6 | 98 |
| C13 | 8 | 2.06 | 7 | 96 |
| E19A | 64 | 20.81 | 4 | 99 |
| E19B | 128 | 42.23 | 8 | 98 |
| C14 | 8 | 2.06 | 7 | 96 |
| E20 | 64 | 20.81 | 6 | 98 |

EXAMPLES 21 to 22

Photopolymerizable elements were prepared and tested as described in Examples 1 to 6 with the following exceptions: the photopolymerizable elements had the composition in parts shown in Table 11 below. The results are shown in Table 12 below. The weight of solids was 30%.

TABLE 11

| Ex. | B2 | B4 | B7 | M3 | M4 | I1 | CT1 | A1 | A2 | A3 | A4 | IN3 |
|---|---|---|---|---|---|---|---|---|---|---|---|---|
| 21 | 37.8 | 15 | 1 | 15.5 | 10.7 | 8 | 0.1 | 3.1 | 3 | 5.7 | 0.1 | 0.15 |
| 22 | 36.8 | 15 | 3 | 17.0 | 8.0 | 8 | 0.1 | 3.1 | 3 | 5.7 | 0.1 | 0.15 |

TABLE 12

| Control or Example | E (sec) | S (mJ/cm$^2$) | SW | HD* (%) | SD (%) |
|---|---|---|---|---|---|
| 21 | 40 | 20.7 | 5 | 2 | 98 |
| 22 | 34 | 17.9 | 5 | 2 | 98 |

*HD means highlight dots

EXAMPLE 23

A four color proof is obtained by following the steps described below. First, complementary registration marks are cut into the photopolymerizable layers of the electrostatic masters prior to exposure. Masters for each of the four color separations are prepared by exposing four photopolymerizable elements having coversheets to one of the four color separation negatives corresponding to cyan, yellow, magenta and black colors. Each of the four photopolymerizable layers is exposed for about 45 seconds using the Douthitt Option X Exposure Unit described above. The visible radiation emitted by this source is suppressed by a UV light transmitting, visible light absorbing Kokomo ® glass filter (No. 400, Kokomo Opalescent Glass Co., Kokomo, Ind). The cover sheets are removed, and each master is mounted on the corresponding color module drum, in a position assuring image registration of the four images as they are sequentially transferred from each master to the receiving paper. The leading edge clamps are also used to ground the photopolymer aluminized backplane to the drum. The masters are stretched by spring loading the trailing edge assuring that each lays flat against its drum.

Each module comprised a charging scorotron at 3 o'clock position, a developing station at 6 o'clock, a metering station at 7 o'clock and a cleaning station at 9 o'clock. The charging, developing, and metering procedure is similar to that described above prior to the examples. The transfer station consists of a tackdown roll, a transfer corona, paper loading, and a positioning device that fixes the relative position of paper and master in all four transfer operations.

In the preparation of the four-color proof the four developers, or toners, have the following compositions:

| INGREDIENTS | AMOUNT (g) |
|---|---|
| BLACK | |
| Copolymer of ethylene (89%) and methacrylic acid (11%), melt index at 190° C. is 100, Acid No. is 66 | 2,193.04 |
| Sterling NF carbon black | 527.44 |
| Heucophthal Blue, G XBT-583D Heubach, Inc., Newark, NJ | 27.76 |
| Basic Barium Petronate ®, Witco Chemical Corp., New York, NY | 97.16 |
| Aluminum tristearate, Witco 132 Witco Chemical Corp., New York, NY | 27.76 |
| Isopar ®-L, non-polar liquid having a Kauri-Butanol value of 27, Exxon Corporation | 188,670 |
| CYAN | |
| Copolymer of ethylene (89%) and methacrylic acid (11%), melt index at 190° C. is 100, Acid No. is 66 | 3,444.5 |
| Ciba-Geigy Monarch Blue X3627 | 616.75 |
| Dalamar ® Yellow YT-858D Heubach, Inc., Newark, NJ | 6.225 |

-continued

| INGREDIENTS | AMOUNT (g) |
|---|---|
| Aluminum tristearate, as described in black developer | 83.0 |
| Basic Barium Petronate ® (Witco Chemical Corp.) | 311.25 |
| Isopar ®-L as described in black developer | 293,000 |
| MAGENTA | |
| Copolymer of ethylene (89%) and methacrylic acid (11%), melt index at 190° C. is 100, Acid No. is 66 | 4,380.51 |
| Mobay RV-6700, Mobay Chemical Corp., Haledon, NJ | 750.08 |
| Mobay RV-6713, Mobay Chemical Corp. Haledon, NJ | 750.08 |
| Aluminum tristearate, as described in black developer | 120.014 |
| Triisopropanol amine | 75.008 |
| Basic Barium Petronate ® (Witco Chemical Corp.) | 720.08 |
| Isopar ®-L as described in black developer | 446,270 |
| YELLOW | |
| Copolymer of ethylene (89%) and methacrylic acid (11%), melt index at 190° C. is 100. Acid No. is 66 | 1,824.75 |
| Yellow 14 polyethylene flush, Sun Chemical Co., Cincinnati, OH | 508.32 |
| Aluminum tristearate, as described in black developer | 46.88 |
| Basic Barium Petronate ® (Witco Chemical Corp.) | 59.5 |
| Isopar ®-L as described in black developer | 160,190 |

First, the cyan master is charged, developed and metered. The transfer station is positioned and the toned cyan image transferred onto the paper. After the cyan transfer is completed, the magenta master is corona charged, developed and metered, and the magenta image transferred, in registry, on top of the cyan image. Afterwards, the yellow master is corona charged, developed, and metered, and the yellow image is transferred on top of the two previous images. Finally the black master is corona charged, developed, metered, and the toned black image transferred, in registry, on top of the three previously transferred images. After the procedure is completed, the paper is carefully removed from the transfer station and the image fused for 15 seconds at 100° C.

The parameters used for preparation of the proof are: drum speed, 2.2 inches/second (5.588 cm/second); grid scorotron voltage, 100 to 400 V; scorotron current 200 to 1000 microamps (5.11 to 6.04 kV); metering roll voltage, 20 to 200 V; tackdown roll voltage, −1.5 to −5.0 kV; transfer corona current; 50 to 150 microamps (4.35 to 4.88 kV); metering roll speed, 4 to 8 inches/-second (10.16 to 20.32 cm/second.); metering roll gap, 0.002 to 0.005 inches (0.051 to 0.127 mm); developer conductivity 12 to 30 picomhos/cm; developer concentration, 1 to 2% solids.

The following composition is prepared from the indicated ingredients in parts:

| M3 | M2 | I1 | B2 | B4 | CT1 | A1 | A2 | A3 | IN1 |
|---|---|---|---|---|---|---|---|---|---|
| 15.5 | 8 | 8 | 41.5 | 15 | 0.15 | 3.175 | 3 | 5.7 | 0.1 |

After the solution is stirred for 24 hr to properly dissolve all the components, it is coated onto aluminized polyethylene terephthalate at 150 ft/min (45.7 m/min) coating speed. Coating weight is about 130 mg/dm$^2$. A polypropylene cover sheet is placed on the photopolymer surface immediately after drying. The material thus formed is cut into four pieces about 30 inch by 40 inch (76.2 cm by 101.6 cm) for preparation of a four color proof.

A four color proof is obtained by following the general procedure for making a four color proof outlined above using cyan, magenta, yellow and black photohardenable electrostatic masters.

This example illustrates the use of the photohardenable electrostatic master to prepare a four color proof.

We claim:

1. A photohardenable electrostatic master comprising (1) an electrically conductive substrate, and coated thereon (2) a layer of photohardenable composition having a speed that requires an exposure energy in the range of 3 to 90 mjoules/sq. cm. consisting essentially of (a) at least two incompatible organic polymeric binders, 40 to 70% by weight, (b) at least one monomeric compound having at least one ethylenically unsaturated group, 10 to 40% by weight, (c) a photoinitiator or photoinitiator system that activates polymerization of the at least one ethylenically unsaturated monomer upon exposure to actinic radiation, 1 to 20% by weight, (d) a chain transfer agent, 0.05 to 10% by weight, and (e) at least one polymerization inhibitor in an amount of 0.1% to 4% by weight, all percentages based on the total weight of photohardenable composition.

2. A photohardenable electrostatic master according to claim 1 wherein the layer of photohardenable composition has a speed that requires an exposure energy in the range of 3 to 30 mjoules/sq.cm.

3. A photohardenable electrostatic master according to claim 1 wherein the polymerization inhibitor is a compound selected from the group consisting of cyclic phenylhydrazides, alkyl and aryl substituted phenols, quinones and hydroquinones, tertbutyl catechol, 1,2,3-trihydroxybenzene, β-naphthol, phenothiazine, nitrobenzene, dinitrobenzene, trinitrofluorenone, p-phenylenediamine, nitromethylaniline, hydroxymethylaniline, nitrosodimethylaniline, 1-(2'-nitro-4',5'-dimethyoxy)phenyl-1-(4-t-butyl phenoxy)ethane and dinitroso dimers.

4. A photohardenable electrostatic master according to claim 3 wherein a cyclic phenylhydrazide polymerization inhibitor is 1-phenylpyrazolidine-3-one.

5. A photohardenable electrostatic master according to claim 3 wherein the polymerization inhibitor is 1,4,4-trimethyl-2,3-diazobicyclo-(3.2.2)non-2-ene-N,N-dioxide.

6. A photohardenable electrostatic master according to claim 3 wherein the polymerization inhibitor is p-benzoquinone.

7. A photohardenable electrostatic master according to claim 1 wherein the incompatible organic polymeric binders are selected from at least one binder having a Tg higher than 80° C. and at least one binder having a Tg lower than 70° C.

8. A photohardenable electrostatic master according to claim 7 wherein the binder having a Tg higher than 80° C. is selected from the group consisting of acrylate and methacrylate polymers and copolymers, vinyl polymers and copolymers, polyvinyl acetals, polycarbonates, polysulfones, polyetherimides, and polyphenylene oxides.

9. A photohardenable electrostatic master according to claim 8 wherein the binder is a methacrylate polymer or copolymer.

10. A photohardenable electrostatic master according to claim 9 wherein the binder is poly(styrene/methyl methacrylate).

11. A photohardenable electrostatic master according to claim 9 wherein the binder is poly(methyl methacrylate).

12. A photohardenable electrostatic master according to claim 8 wherein the binder is polycarbonate.

13. A photohardenable electrostatic master according to claim 8 wherein the binder is polysulfone.

14. A photohardenable electrostatic master according to claim 7 wherein the binder with a Tg lower than 70° C. is selected from the group consisting of acrylate and methacrylate polymers and copolymers, vinyl polymers and copolymers, polyvinyl acetals, polyesters, polyurethanes, butadiene copolymers, cellulose esters and cellulose ethers.

15. A photohardenable electrostatic master according to claim 14 wherein the binder is a methacrylate polymer or copolymer.

16. A photohardenable electrostatic master according to claim 15 wherein the binder is poly(ethyl methacrylate).

17. A photohardenable electrostatic master according to claim 15 wherein the binder is poly(isobutyl methacrylate).

18. A photohardenable electrostatic master according to claim 15 wherein the binder is poly(cyclohexyl methacrylate).

19. A photohardenable electrostatic master according to claim 15 wherein the binder is poly(tertiary-butyl acrylate).

20. A photohardenable electrostatic master according to claim 1 wherein a monomeric compound (b) is an acrylate or methacrylate compound having at least two terminal ethylenically unsaturated groups.

21. A photohardenable electrostatic master according to claim 20 wherein a monomeric compound is glycerol propoxylated triacrylate.

22. A photohardenable electrostatic master according to claim 1 wherein the at least one monomeric compound is a mixture of glycerol propoxylated triacrylate and trimethylolpropane triacrylate.

23. A photohardenable electrostatic master according to claim 1 wherein the photoinitiator is a 2,4,5-triphenylimidazolyl dimer.

24. A photohardenable electrostatic master according to claim 23 wherein the photoinitiator is 2,2',4,4'-tetrakis(o-chlorophenyl)-5,5'-bis(m,p-dimethoxyphenyl)-biimidazole.

25. A photohardenable electrostatic master according to claim 23 wherein the photoinitiator is 2,2'-bis(o-chlorophenyl)-5,5'-bis(m-methoxyphenyl)biimidazole.

26. A photohardenable electrostatic master according to claim 1 wherein the chain transfer agent is selected from the group consisting of N-phenylglycine, 1-1-dimethyl-3,5-diketocyclohexane, 2-mercaptobenzothiazole, 2-mercaptobenzoxazole, 2-mercaptobenzimidazole, pentaerythritol tetrakis(mercaptoacetate), 4-acetamidothiophenol, mercaptosuccinic acid, dodecanethiol, beta-mercaptoethanol, 2-mercaptoethane sulfonic acid, 1-phenyl-4H-tetrazole-5-thiol, 6-mercaptopurine monohydrate, bis-(5-mercapto-1,3,4-thiodiazol-2-yl, 2-mercapto-5-nitrobenzimidazole, and 2-mercapto-4-sulfo-6-chlorobenzoxazole.

27. A photohardenable electrostatic master according to claim 26 wherein the chain transfer agent is 2-mercaptobenzoxazole.

28. A photohardenable electrostatic master according to claim 26 wherein the chain transfer agent is 2-mercaptobenzimidazole.

29. A photohardenable electrostatic master according to claim 1 wherein the photoinitiator is a benzil ketal.

30. A photohardenable electrostatic master according to claim 29 wherein the photoinitiator is dimethoxy-2-phenylacetophenone.

31. A photohardenable electrostatic master according to claim 1 wherein the photoinitiator is a benzoin ether.

32. A photohardenable electrostatic master according to claim 31 wherein the photoinitiator is benzoin methyl ether.

33. A photohardenable electrostatic master according to claim 1 wherein a sensitizer compound is present.

34. A photohardenable electrostatic master according to claim 33 wherein the sensitizer compound is 2-{9'-(2',3',6',7'-tetrahydro-1H,5H-benzo[i,j]-quinolyidene)}-5,6-dimethoxy -1indanone.

35. A photohardenable electrostatic master according to claim 1 wherein the layer of photohardenable composition consists essentially of (a) poly(styrene/methyl methacrylate) and poly(ethyl methacrylate), (b) a monomeric compound selected from the group consisting of glycerol propoxylated triacrylate, trimethylol propane triacrylate and mixtures thereof, and (c) 2,2',4,4'-tetrakis(o-chlorophenyl)-5,5'-bis (m,p-dimethoxyphenyl)biimidazole, (d) mercaptobenzoxazole, and (e) 1-phenylpyrazolidine-3-one

36. A photohardenable electrostatic master according to claim 1 wherein the polymeric binder component (a) is present in 50 to 65% by weight, the monomeric compound component (b) in 20 to 35% by weight, the photoinitiator component (c) in 2 to 10% by weight, the chain transfer agent is present in the amount of 0.05 to 4% by weight, and the polymerization inhibitor is present in the amount of 0.1 to 2.5% by weight, the weight percentages based on the total weight of the photohardenable composition.

* * * * *